US011721302B2

(12) United States Patent
Lin et al.

(10) Patent No.: US 11,721,302 B2
(45) Date of Patent: Aug. 8, 2023

(54) DISPLAY DEVICE CAPABLE OF SWITCHING DISPLAY MODE AND METHOD THEREOF

(71) Applicant: ASUSTeK COMPUTER INC., Taipei (TW)

(72) Inventors: Yu-Ching Lin, Taipei (TW); Huei-Ching Hu, Taipei (TW); Ya-Ni Su, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 17/094,922

(22) Filed: Nov. 11, 2020

(65) Prior Publication Data

US 2021/0210047 A1 Jul. 8, 2021

(30) Foreign Application Priority Data

Jan. 8, 2020 (TW) ..... 109100654

(51) Int. Cl.
*G09G 5/00* (2006.01)

(52) U.S. Cl.
CPC ..... *G09G 5/006* (2013.01); *G09G 2340/0407* (2013.01); *G09G 2354/00* (2013.01)

(58) Field of Classification Search
CPC ..... G09G 5/006; G09G 2354/00; G09G 2340/0407; G09G 2340/0435
USPC ..... 345/428
See application file for complete search history.

(56) References Cited

U.S. PATENT DOCUMENTS

2003/0151687 A1* 8/2003 Yoshida ..... H04N 5/2355 348/222.1
2004/0070620 A1* 4/2004 Fujisawa ..... H04N 21/4532 715/764
2005/0001787 A1* 1/2005 Montgomery ..... H04N 13/359 348/E13.033
2005/0195175 A1* 9/2005 Anderson ..... G09G 3/2018 345/204
2006/0038752 A1* 2/2006 Winters ..... H01L 27/3267 345/76
2006/0048062 A1* 3/2006 Adamson ..... G09G 5/363 715/810

(Continued)

FOREIGN PATENT DOCUMENTS

CN 1797375 A 7/2006
CN 105825801 A 8/2016

(Continued)

*Primary Examiner* — James A Thompson
*Assistant Examiner* — Kim Thanh T Tran
(74) *Attorney, Agent, or Firm* — McClure, Qualey & Rodack, LLP

(57) ABSTRACT

The present disclosure provides a method capable of switching display modes with a display screen having a plurality of pixels. The method includes: providing a selection interface on the display, wherein the selection interface provides a first display setting and a second display setting; determining whether the first display setting or the second display setting is selected, wherein when the first display setting is selected, the controller controls to display an image content with the plurality of pixels of the display; when the second display setting is selected, the plurality of pixels of the display are merged into a plurality of merges Pixel group to display image content.

7 Claims, 2 Drawing Sheets

(56) References Cited

U.S. PATENT DOCUMENTS

| | | | | |
|---|---|---|---|---|
| 2012/0082339 | A1* | 4/2012 | Sakai | H04L 12/1813 382/103 |
| 2019/0035354 | A1 | 1/2019 | Cheng et al. | |
| 2020/0167303 | A1* | 5/2020 | Kim | G06F 13/4286 |
| 2020/0312270 | A1 | 10/2020 | Rao | |

FOREIGN PATENT DOCUMENTS

| | | | |
|---|---|---|---|
| CN | 109830204 | A | 5/2019 |
| TW | 201911027 | A | 3/2019 |

* cited by examiner

DISPLAY DEVICE CAPABLE OF SWITCHING DISPLAY MODE AND METHOD THEREOF

CROSS-REFERENCE TO RELATED APPLICATION

This application claims the priority benefit of Taiwan applications serial No. 109100654, filed on Jan. 8, 2020. The entirety of the above-mentioned patent application is hereby incorporated by reference herein and made a part of specification.

BACKGROUND OF THE INVENTION

Field of the Invention

The invention relates to a display device and, more particularly, to a display device and a method for controlling the same.

Description of the Related Art

A display is an output device that used to display images. Taking a notebook computer as an example, a notebook currently supports the resolution and the refresh frequency of the panel default standard or the Video Electronics Standards Association (VESA) standard, and cannot increase the refresh frequency based on the changing of the resolution.

BRIEF SUMMARY OF THE INVENTION

A display device and a method capable of switching display mode of the display device are provided.

In an embodiment, a display device capable of switching display mode includes a display screen, a driver, a connector, and a controller. The display screen includes a plurality of pixels, the driver is electrically connected with the display screen, and the controller is electrically connected with the connector and the driver. The connector is for receiving a first display setting or a second display setting and an image content. The controller controls to display the image content through the pixels of the display screen when the connector receives the first display setting, and the controller integrates the pixels of the display screen into a plurality of merging pixel groups to display the image content when the connector receives the second display setting.

In an embodiment, a method capable of switching display mode cooperating with a display screen with a plurality of pixels is provided. The method includes: providing a selection interface on the display screen, the selection interface provides a first display setting and a second display setting; determining whether the first display setting or the second display setting is selected, wherein when the first display setting is selected, display an image content through the pixels of the display screen, when the second display setting is selected, integrate the pixels of the display screen into a plurality of merging pixel groups to display the image content.

In summary, the display device and method capable of switching display mode provide different resolutions for the display to increase or decrease the refresh frequency.

These and other features, aspects and advantages of the present invention will become better understood with regard to the following description, appended claims, and accompanying drawings.

DETAILED DESCRIPTION OF THE EMBODIMENTS

Figure 1:
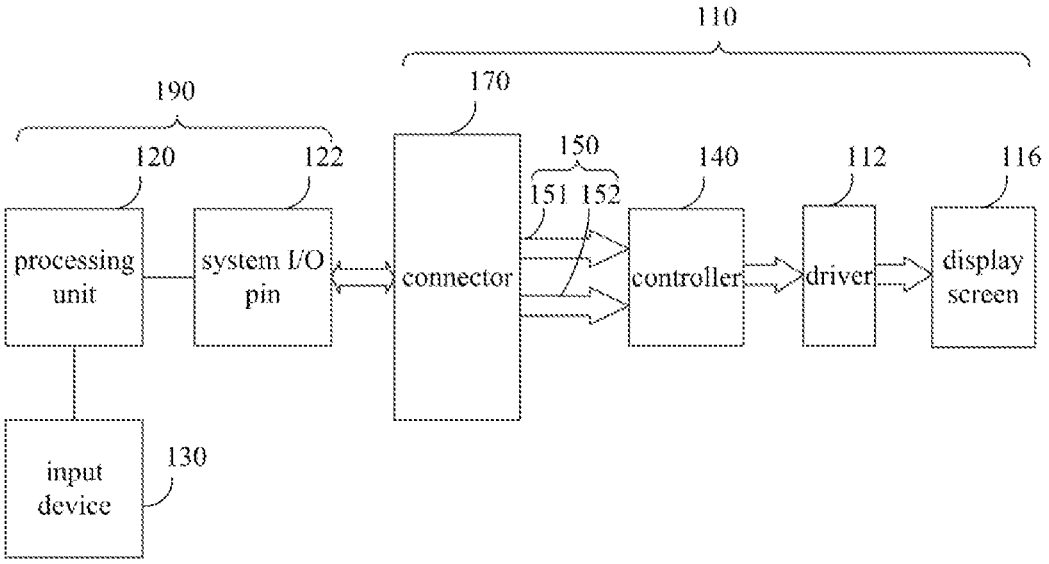
FIG. 1 is a block diagram of a system capable of switching resolution and refresh frequency according to an embodiment.

To make the description more detailed and complete, reference may be made to the accompanying drawings and various embodiments described below. The elements in the drawings are not drawn to scale and are provided only to illustrate the disclosure. Many practical details are described below to provide a comprehensive understanding of this disclosure. However, those of ordinary skill in the relevant arts should understand that this disclosure can be implemented without one or more practical details. Therefore, these details are not to limit this disclosure.

In the embodiments and the scope of claims, the description relates to "connection", which generally refers to an element indirectly coupled to another element through other elements, or an element directly connected to another element without other elements.

In the embodiments and the scope of claims, unless there are special restrictions on articles in the text, "a" and "the" refer to single or plural.

As used in this article, "about", "approximately" or "roughly" are used to indicate any quantity that can be slightly changed, but the slight change will not change its essence. Unless otherwise specified in the embodiments, the error range of the value expressed by "about", "approximately" or "roughly" is generally allowed within 20%, and preferably it is within 10%, and more preferably it is within 5%.

In an embodiment, in the display device 110 capable of switching display mode of FIG. 1, a transmission port 150 includes an embedded display port (eDP) 152 and a control pin 151. In architecture, the eDP 152 is electrically connected to a connector 170 and a controller 140, and the control pin 151 is electrically connected to the connector 170 and the controller 140. The eDP 152 sends an image content to the controller 140, and the control pin 151 sends a first display setting or a second display setting to the controller 140 of the display device 110 to switch the resolution and the refresh frequency correspondingly.

Figure 2:
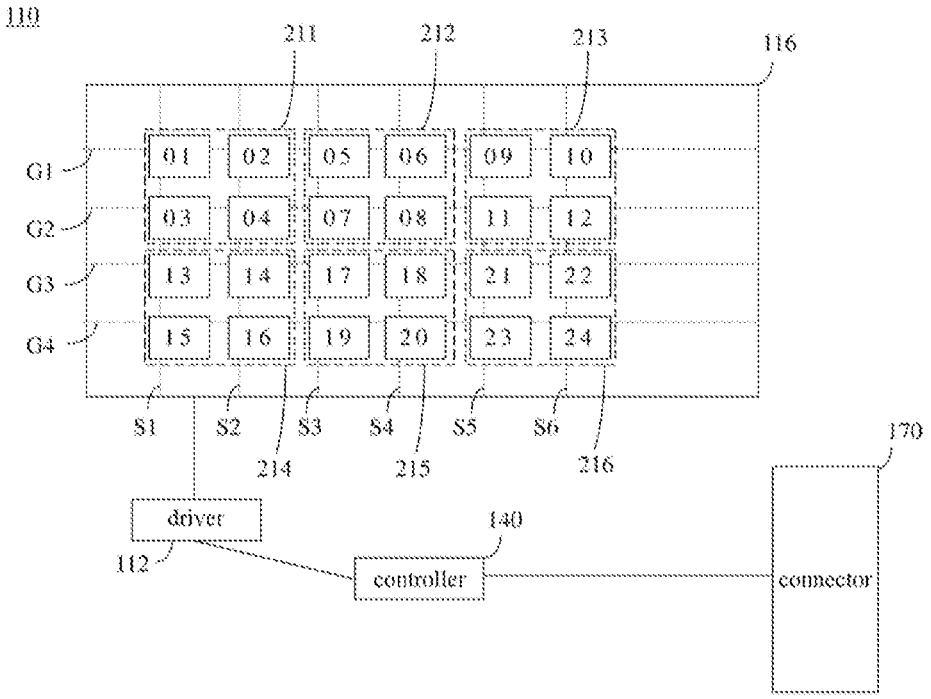
FIG. 2 is a schematic diagram of a display capable of switching resolution and refresh frequency according to an embodiment.

In order to further illustrating on the mechanism of the display device 110 to switch the display mode, please refer to FIG. 1 to FIG. 2. FIG. 2 is a schematic diagram of a display device 110 capable of switching resolution and refresh frequency according to an embodiment. As shown in FIG. 2, the display device 110 includes a connector 170, a controller 140, a driver 112 and a display screen 116. In architecture, the connector 170 is electrically connected to the controller 140 by connecting with a transmission port 150, the driver 112 is electrically connected to the controller 140, and the display screen 116 is electrically connected to the driver 112. The display screen 116 has a plurality of pixel 01 to pixel 24. In one embodiment, the driver 112 is a source driver and/or other the driver, and the controller 140 is a timing controller (Tcon).

The connector 170 receives a first display setting or a second display setting and an image content from an electronic device 190. In one embodiment, when the first display setting is selected, the controller 140 receives the first display setting from the connector 170. After the controller 140 converts the image content, the controller 140 informs the driver 112 to drive the display screen 116 to display the image content with the first display setting through the pixel 01 to pixel 24.

Taking pixel 01 as an example, pixel 01 includes a transistor switch (not shown), the gate of the transistor switch is electrically connected to a scan line G1, the source of the transistor switch is electrically connected to a signal line S1, and the drain of the transistor switch is electrically connected to the pixel capacitor. When the display screen 116 scans the scan line G1, the voltage applied to the scan line G1 turns on the transistor switch of the pixel 01, and the data on the signal line S1 is written into the pixel capacitor to refresh the pixel 01. The relationships between the remaining pixels 02 to 24, the scan lines G1 to G4, and the signal lines S1 to S6 are is similar to this. It should be understood that the relevant knowledge of the pixel structure is a well-known technology for those with ordinary skill in the art, and is not the protecting scope of the present invention, which will not be detailed here.

In an embodiment, when the second display setting is selected, the controller 140 receives the second display setting from the connector 170, and integrates the plurality of pixels into a plurality of merging pixel groups. The driver 112 displays the image content with the second resolution and the second refresh frequency through the second of the merging pixel groups 211 to 216. The plurality of pixels in any one of the merging pixel groups 211 to 216 are refreshed synchronously, and the plurality of pixels in any one of the merging pixel groups 211 to 216 display the same color.

Taking the merging pixel group 211 as an example, the merging pixel group 211 includes pixels 01 to 04. The display screen 116 scans the scan lines G1 and G2 simultaneously, and the driver 112 writes the data with the same color to the pixels 01 to 04 through the signal line S1, S2. Thereby, the refresh frequency of the display screen 116 is increased from the first refresh frequency to the second refresh frequency. On the other hand, by combining pixels 01 to 04 to display the same color, the resolution of the display screen 116 is decreased from a first resolution to a second resolution.

For example, the first resolution of the first display setting of the display screen 116 is 3840*2160 in UHD (Ultra High Definition), and the first refresh frequency of the first display setting is 60 Hz. The meaning of the refresh frequency 60 Hz is that 60 frames need to appear in 1 second. In other words, each frame needs 1/60=16.7 ms. The time required for each scan line is 16.7 ms/2160 (corresponding to the number of the scan lines)=0.0077 ms.

When the second display setting is received, the resolution decreases to 1920*1080 in FHD (Full High Definition). Based on that the time required for each scan line (the horizontal axis) does not change, 16.7 ms/2160 (corresponding to the number of the scan line)=0.0077 ms. Reversely inferring the refresh frequency: 0.0077 ms*1080=8.316 ms, 1/the refresh frequency=8.316, therefore, the refresh frequency becomes 120 Hz.

In one embodiment, the system 100 capable switching display mode provides a third display setting, and a third resolution of the third display setting is lower than the second resolution, and a third refresh frequency of the third display setting is higher than the second refresh frequency. Furthermore, the system 100 capable to switch display setting provides a fourth display setting, a fifth display setting, and so on.

Figure 3:
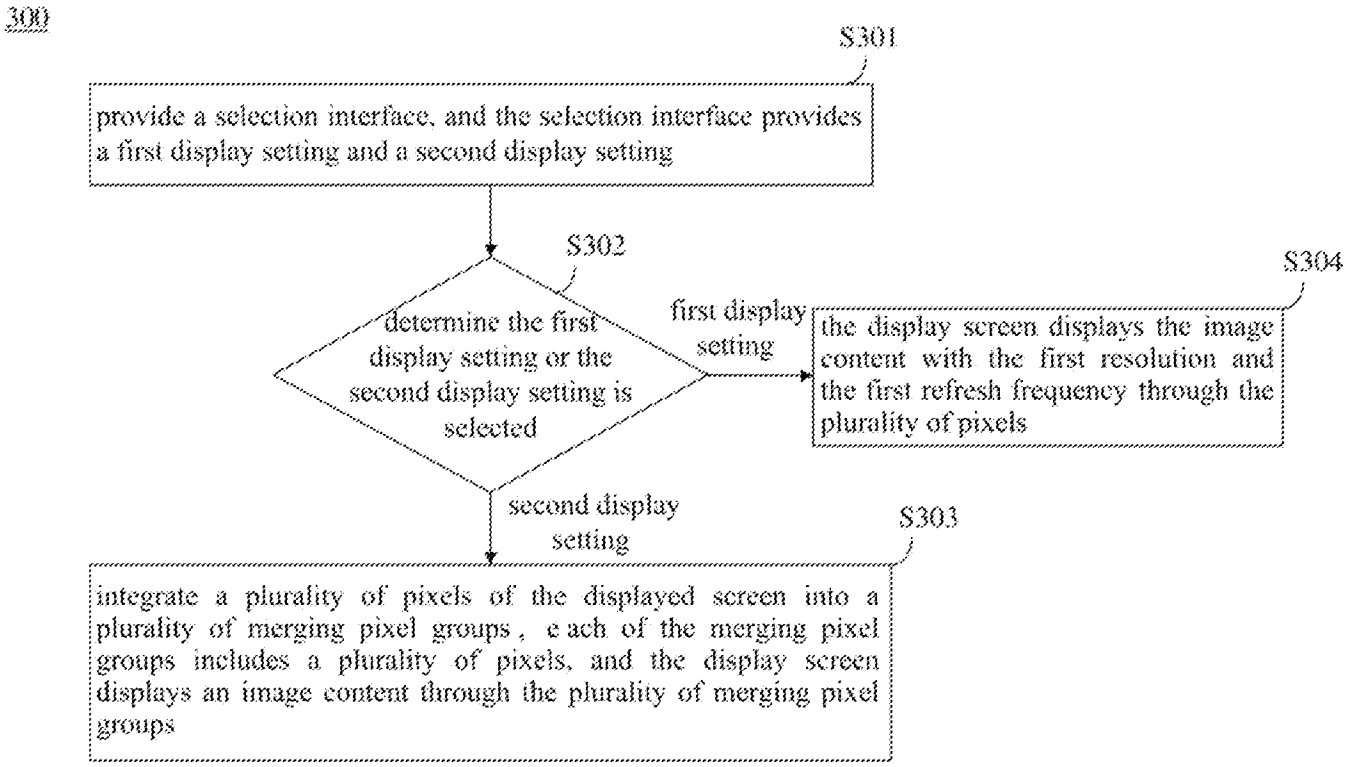
FIG. 3 is a flowchart of a method capable of switching resolution and refresh frequency according to an embodiment.

In order to further illustrate the operation method mentioned above, please also refer to FIG. 1 to FIG. 3. FIG. 3 is a flowchart of a method 300 capable of switching resolution and refresh frequency according to an embodiment. As shown in FIG. 3, the method 300 of switching display mode, in cooperation with the display screen including a plurality of pixels, includes steps S301 to S304 (It should be understood that the steps mentioned in the embodiment, except for those whose sequences are specifically stated, are adjustable according to actual needs, and even can be performed simultaneously or partially).

In step S301, provide a selection interface on a display screen, and the selection interface provides a first display setting and a second display setting.

In step S302, determine the first display setting or the second display setting is selected.

When the second display setting is selected, in step S303, integrate a plurality of pixels of the display screen 116 into a plurality of merging pixel groups. Each of the merging pixel groups includes a plurality of pixels, and the display screen 116 displays an image content through the plurality of merging pixel groups.

When the first display setting is selected, in step S304, the display screen 116 displays the image content through the plurality of pixels.

In an embodiment, the first display setting includes a first resolution and a first refresh frequency, and the second display setting includes a second resolution and a second refresh frequency. The first resolution is higher than the second resolution, and the first refresh frequency is lower than the second refresh frequency.

In the method 300 of switching the display mode, receive the image content and the first display setting or the second display setting from the electronic device 190, and transmit the image content and the first display setting or the second display setting to the display device 110 through at least one transmission port 150. The display device 110 includes a connector 170, a controller 140, a driver 112 and a display screen 116.

In the method 300 of switching the display mode, receive the image content and the first display setting or the second display setting through the connector 170. When the controller 140 receives the first display setting, the driver 112 drives the display screen 116 to display the image content with the first resolution and the first refresh frequency through the plurality of pixels. When the controller 140 receives the second display setting, the controller 140 integrates the plurality of pixels into the plurality of merging pixel groups, and the driver 112 drives the display screen 116 to display the image content with the second resolution and the second refresh frequency through the plurality of merging pixel groups, wherein the plurality of pixels in any one of the merging pixel groups are synchronized refreshed, and the plurality of pixels in any one of the merging pixel groups display the same color.

In the method 300 of switching the display mode, transmit the image content to the controller 140 through the eDP 152, and transmit the first display setting or the second display setting to the controller through the control pin 151.

Back to FIG. 1, FIG. 1 is a block diagram of a system 100 capable of switching display mode. As shown in FIG. 1, the system 100 capable of switching display mode mainly includes a display device 110 and an electronic device 190. The electronic device 190 is electrically connected to the display device 110, and the display device 110 is a display capable of switching display mode. In one embodiment, the electronic device 190 includes a processing unit 120, an input device 130, and the system input/output pin (system I/O pin) 122.

In one embodiment, the display device 110 includes a connector 170, a transmission port 150, a controller 140, a driver 112 and a display screen 116, and the display screen 116 includes the plurality of pixels.

In architecture, the driver 112 is electrically connected to the display screen 116, and the connector 170 is electrically connected to the system I/O pin 122 of the electronic device 190. The transmission port 150 is electrically connected to the connector 170, and the controller 140 is electrically connected to the connector 170 and the driver 112.

In operation, the connector 170 is used to receive the first display setting or the second display setting and the image content. When the connector 170 receives the second display setting, the controller 140 integrates the plurality of pixels of the display screen 116 into the plurality of merging pixel groups, to display the image content with the second resolution and the second refresh frequency.

In an embodiment, the display device 110 is a display, such as a flat display or a curved display. The electronic device 190 is a computer host (such as a notebook computer host, a desktop computer host, and a tablet computer host). The processing unit 120 is a processor, the input device 130 is a keyboard, a mouse, or a touch device, and the touch device and the display screen 116 of the display device 110 are integrated into a touch screen.

The display device 110 displays the selection interface, and the selection interface provides the first display setting and the second display setting. The first display setting corresponds to a first display mode, the first resolution is higher than the second resolution in a second display mode, and the first refresh frequency in the first display mode is lower than the second refresh frequency in the second display mode. Thereby, the user uses the input device 130 to select the first display setting or the second display setting to switch to the first display mode or the second display mode.

When the second display setting is selected, the controller 140 of the display device 110 integrates the plurality of pixels into the plurality of merged pixel groups to display the image content. The second display setting includes the second resolution and the second refresh frequency.

Otherwise, when the first display setting is selected, the controller 140 does not integrate the plurality of pixels of the display device 110, but displays the image content on the display with the first display setting with the pixels. In an embodiment, the first display setting is a preset resolution and a preset refresh frequency corresponding to the preset resolution. In an embodiment, the resolution is UHD and the refresh frequency is 60 Hz, or the resolution is FHD and the refresh frequency is 240 Hz.

The connector 170 receives the image content and the first display setting or the second display setting from the electronic device 190 and transmits it to the controller 140. The controller 140 decides whether to integrate the plurality of pixels into the plurality of merging pixel groups according to the first display setting or the second display setting, and transfers the image content to the driver. Accordingly, the display device 110 is capable to switch the display mode.

In summary, the system 100 capable of switching the display mode and the method 300 capable of switching display mode provide different resolutions for the display device 110, and increase or decrease the refresh frequency.

Although the present invention has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. A display device capable of switching display mode, comprising:

a display screen, including a plurality of pixels;

a driver, electrically connected with the display screen;

a connector, for receiving a first display setting or a second display setting and an image content; and a controller, electrically connected with the connector and the driver, wherein the controller controls to display the image content through the pixels of the display screen when the connector receives the first display setting, and the controller integrates the pixels of the display screen into a plurality of merging pixel groups to display the image content when the connector receives the second display setting;

wherein each one of all the pixels in any one of the merging pixel groups displays the same color when the merging pixel groups display the image content, and the pixels in any one of the merging pixel groups emit lights in the same direction;

wherein the first display setting includes a first resolution and a first refresh frequency, and the second display setting includes a second resolution and a second refresh frequency;

wherein a first resolution of the first display setting is higher than a second resolution of the second display setting, and a first refresh frequency of the first display setting is lower than a second refresh frequency of the second display setting;

wherein the display device switches from the first refresh frequency to the second refresh frequency higher than the first refresh frequency when the merging pixel groups display the image content.

2. The display device capable of switching display mode according to claim 1, wherein the connector is electrically connected with a system input/output pin of an electronic device, and the connector is configured to receive an image content and the first display setting or the second display setting from the electronic device.

3. The display device capable of switching display mode according to claim 1, further comprising a transmission port, wherein the transmission port comprises:

an embedded display port, electrically connected with the connector and the controller, the embedded display port transmits the image content to the controller; and a control pin, electrically connected with the connector and the controller, the control pin sends the first display setting or the second display setting to the controller.

4. A method capable of switching display mode of a display device, cooperating with a display screen with a plurality of pixels, the method comprises:

providing a selection interface on the display screen, the selection interface provides a first display setting and a second display setting;

determining whether the first display setting or the second display setting is selected, wherein when the first display setting is selected, display an image content through the pixels of the display screen, when the second display setting is selected, integrate the pixels of the display screen into a plurality of merging pixel groups to display the image content;

wherein each one of all the pixels in any one of the merging pixel groups displays the same color when the merging pixel groups display the image content, and the pixels in any one of the merging pixel groups emit lights in the same direction;

wherein the first display setting includes a first resolution and a first refresh frequency, and the second display setting includes a second resolution and a second refresh frequency;

wherein a first resolution of the first display setting is higher than a second resolution of the second display setting, and a first refresh frequency of the first display setting is lower than a second refresh frequency of the second display setting;

wherein the display device switches from the first refresh frequency to the second refresh frequency higher than the first refresh frequency when the merging pixel groups display the image content.

5. The method capable of switching display mode according to claim 4, further comprising:

receiving an image content and the first display setting or the second display setting from an electronic device; and transmitting the image content and the first display setting or the second display setting to a display through at least one transmission port.

6. The method capable of switching display mode according to claim 5, wherein the display includes a connector, a controller, a driver and the display screen, the display screen includes the pixels, the method capable of switching display mode further comprises:

receiving the image content and the first display setting or the second display setting through the connector.

7. The method capable of switching display mode according to claim 6, wherein the transmission port includes an embedded display port and a control pin, the method capable of switching display mode further comprises:

transmitting the image content to the controller through the embedded display port; and sending the first display setting or the second display setting to the controller through the control pin.

* * * * *